US005522166A

United States Patent [19]

Martel

[11] Patent Number: 5,522,166

[45] Date of Patent: Jun. 4, 1996

[54] RECEIVER COVER HAVING AN INTEGRAL SCOPE MOUNT

[76] Inventor: Phillip C. Martel, 43551 Applewood, Canton, Mich. 48188

[21] Appl. No.: 359,918

[22] Filed: Dec. 20, 1994

[51] Int. Cl.[6] ..... F41G 1/387

[52] U.S. Cl. ..... 42/101; 33/245; 33/247

[58] Field of Search ..... 33/245, 247, 248, 33/250, 252, 254, 257, 258; 42/101, 103

[56] References Cited

U.S. PATENT DOCUMENTS

| | | | |
|---|---|---|---|
| 3,463,430 | 8/1969 | Rubin et al. | 33/245 |
| 3,513,549 | 5/1970 | Smiley | 33/248 |
| 3,875,675 | 4/1975 | Krisay | 33/245 |
| 3,986,285 | 10/1976 | Krisay | 33/248 |
| 4,044,486 | 8/1977 | Van Holten | 33/250 |
| 4,249,315 | 2/1981 | Hopson, III | 33/250 |
| 4,418,487 | 12/1983 | Stahan | 42/101 |
| 4,779,370 | 10/1988 | Cormack | 42/101 |
| 4,845,871 | 7/1989 | Swan | 42/101 |
| 4,862,624 | 9/1989 | Williams | 33/250 |
| 4,890,407 | 1/1990 | Nichols | 42/103 |
| 4,905,396 | 3/1990 | Bechtel | 42/101 |
| 5,107,612 | 4/1992 | Bechtel | 42/103 |
| 5,142,806 | 9/1992 | Swan | 42/101 |
| 5,343,650 | 9/1994 | Swan | 42/100 |

FOREIGN PATENT DOCUMENTS

| | | | |
|---|---|---|---|
| 2544063 | 10/1984 | France | 33/245 |

OTHER PUBLICATIONS

Fuller & LaMont, "Sumonov SKS–45 Type Carbunes", 1988, Pantera Group, Burbank, CA pp. 11–13, 24–25.

*Primary Examiner*—Stephen M. Johnson
*Attorney, Agent, or Firm*—Young & Basile

[57] ABSTRACT

A replacement receiver cover having an integral scope mounting structure is provided for use on a rifle. A pair of integral side rails are located along the longitudinal axis of the receiver cover and are positioned on opposite sides of the cover. The side rails reduce movement of the receiver cover on the firearm. A pair of integral guides are disposed longitudinally on the outer surface of the receiver cover and form a longitudinal channel located between the guides. The integral guides provide a mounting structure for securing a sighting device to the firearm.

14 Claims, 5 Drawing Sheets

10
7
9
8
6

FIG-4
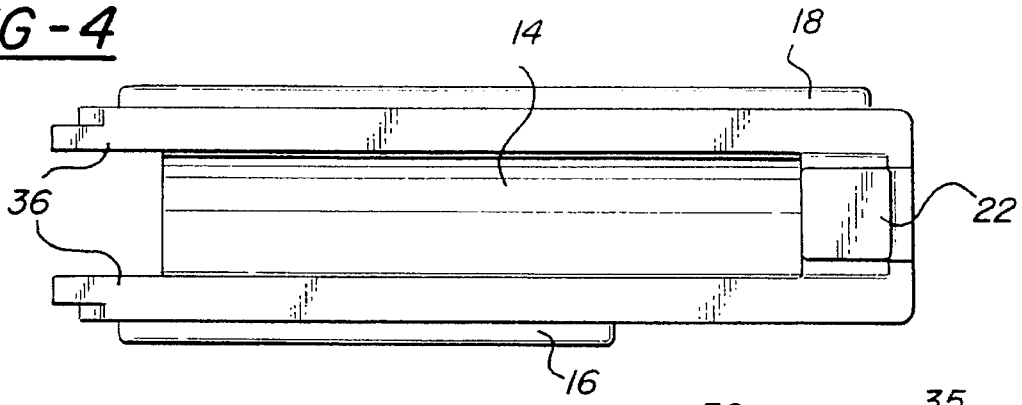
FIG-5
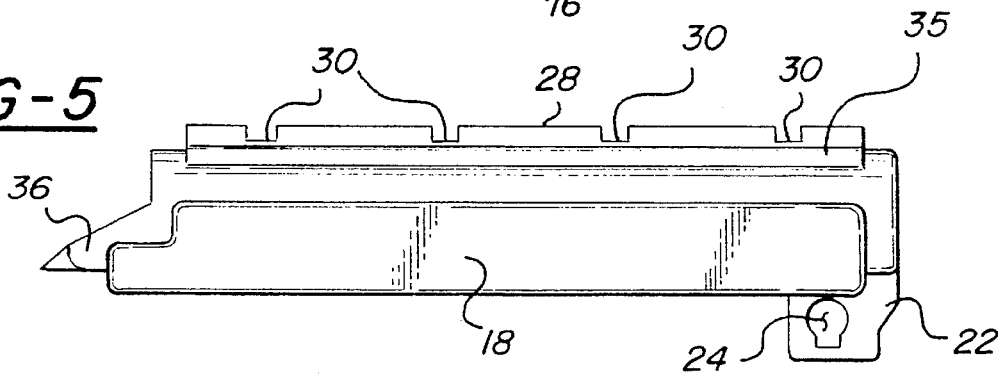
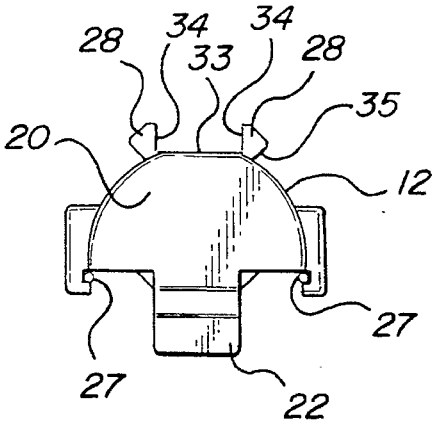
FIG-6
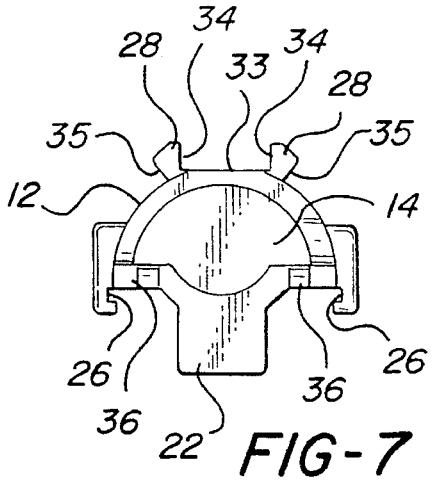
FIG-7
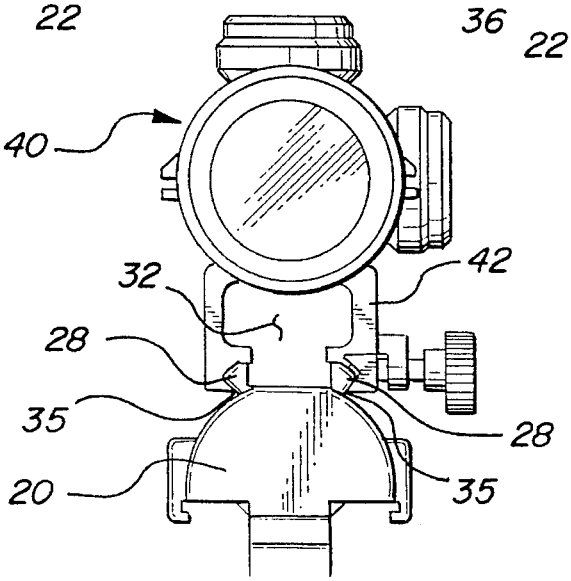
FIG-9

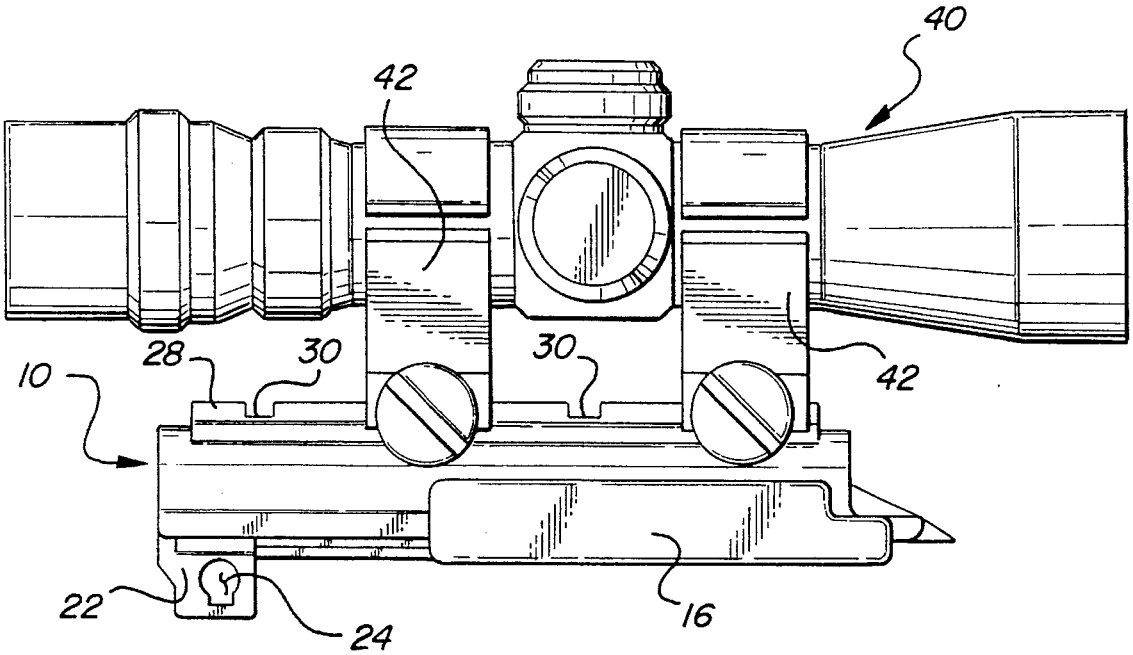
FIG-8
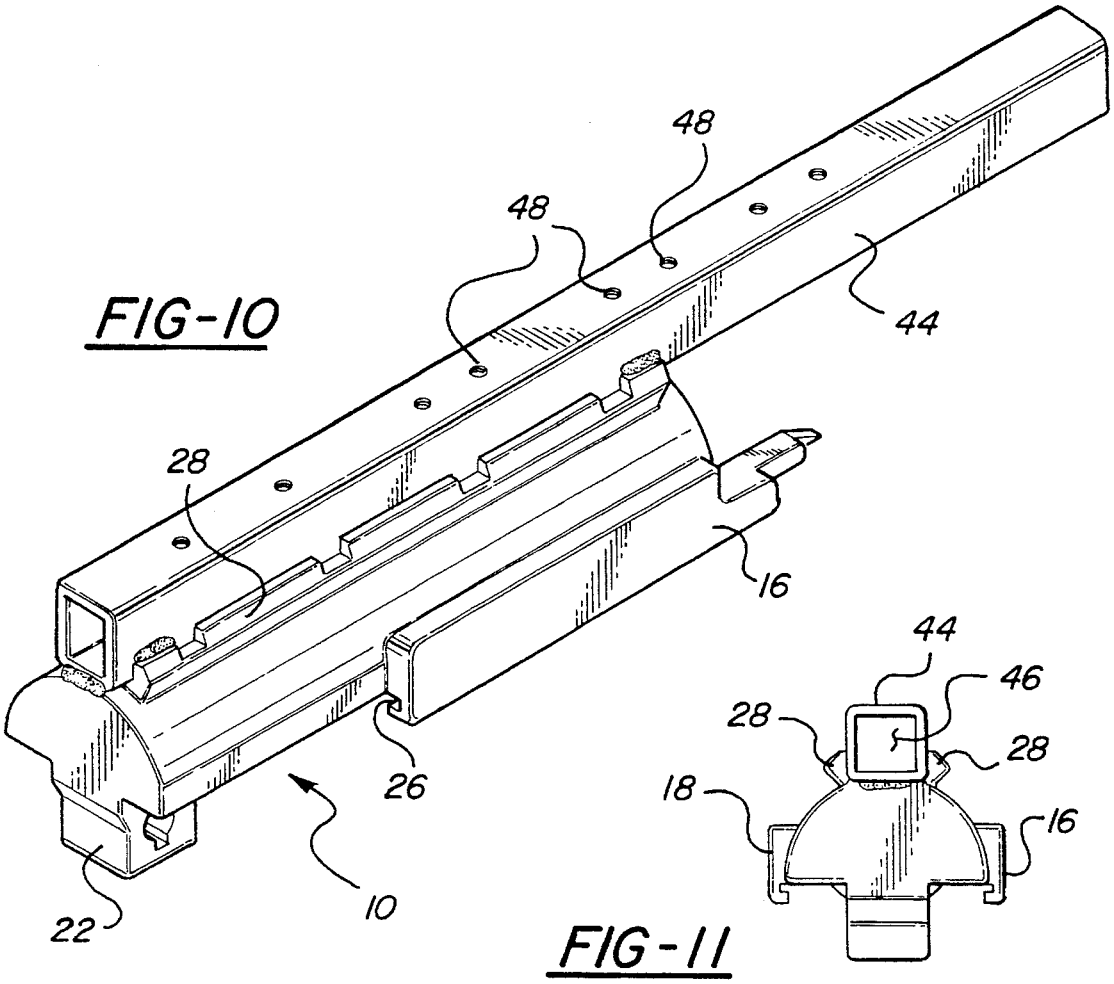
FIG-10
FIG-11

FIG-12
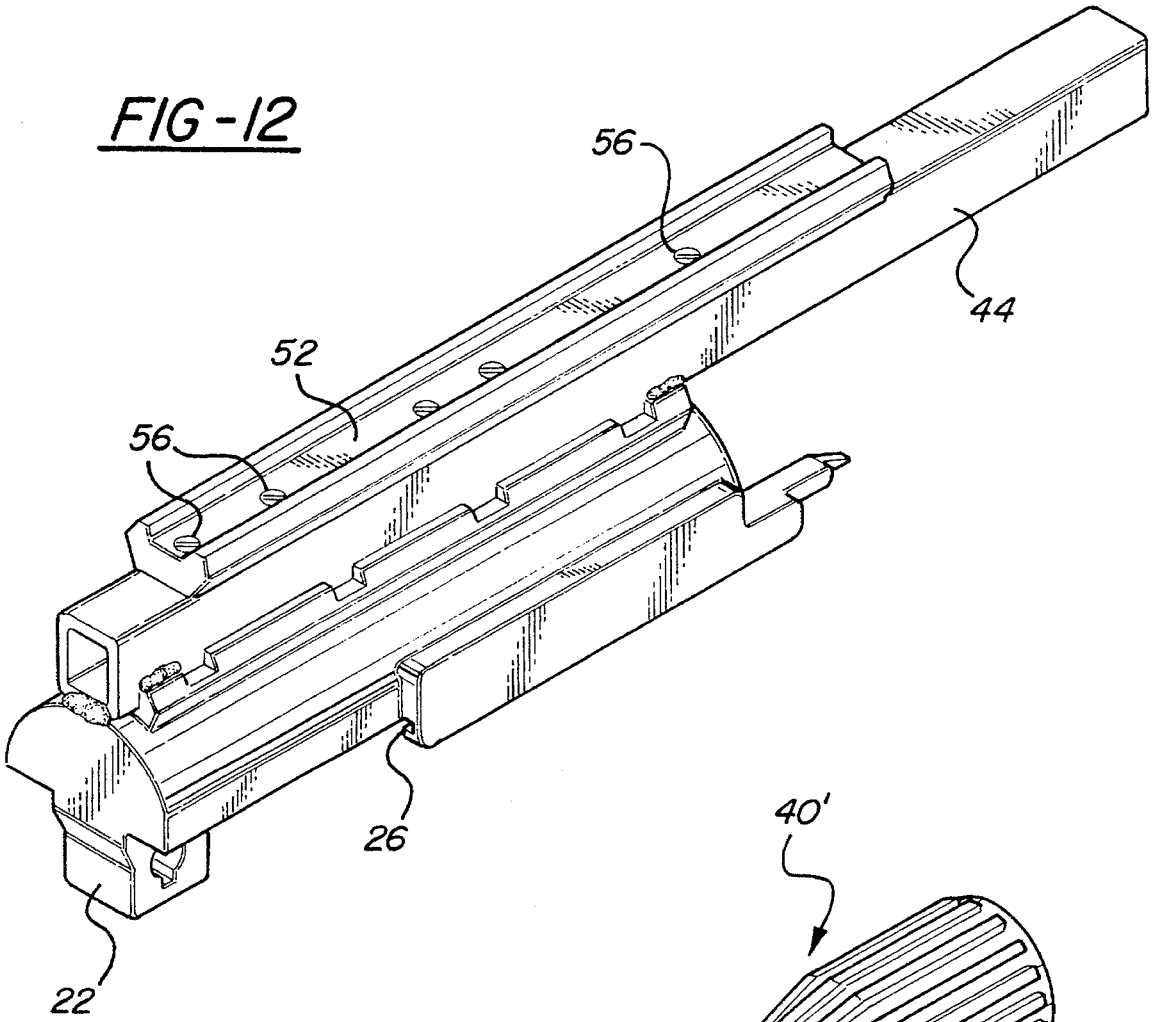
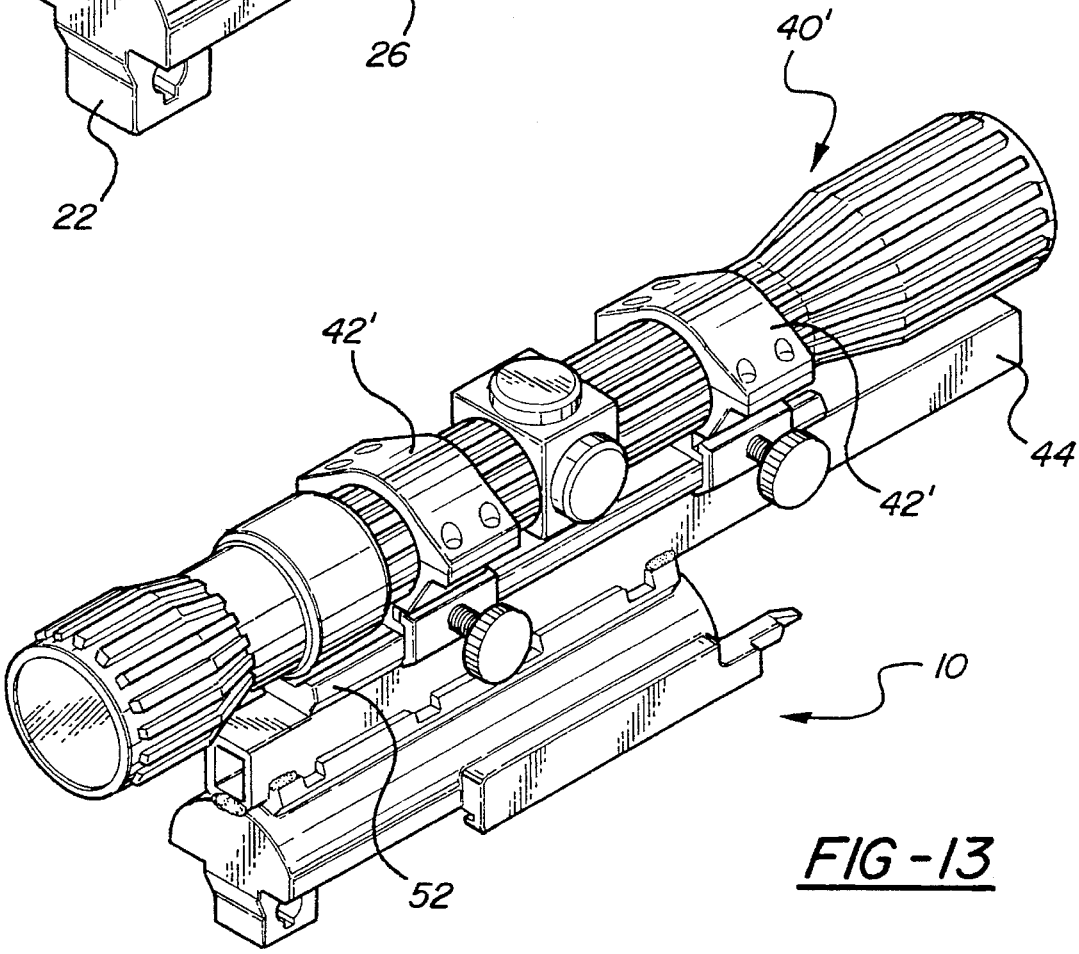
FIG-13

RECEIVER COVER HAVING AN INTEGRAL SCOPE MOUNT

FIELD OF THE INVENTION

The present invention relates to a scope mount for a firearm, and more particularly, to a receiver cover for an SKS rifle having an integral scope mounting structure.

BACKGROUND OF THE INVENTION

Telescopic and optical sighting devices (hereinafter "scopes") are often used on firearms to improve accuracy, target acquisition and low light shooting. Scopes generally allow better accuracy than the conventional metallic or "iron" sights included as standard equipment on most rifles, and rifle owners commonly upgrade their rifles with a scope. Scopes are available in many sizes and magnification levels depending on the requirements of the rifle owner.

Many rifles, however, are not primarily designed for scope mounting; this is often true with military and military surplus rifles. Scope mounting on these rifles often requires machining or drilling/tapping of the receiver to provide a place to fasten a scope base. To avoid the expense of machining, some manufacturers offer aftermarket scope mounts which fasten to the rifle without machining. These no-machine mounts, however, can be somewhat bulky, may interfere with access to the rifle action, and significantly affect both the appearance and heft or balance of the rifle.

Several varieties of the Soviet-designed SKS rifle are commonly owned and commercially available However, the standard SKS rifle does not include scope mounting structure. Attempts have been made to provide an aftermarket side-mounted scope base, but these side-mounted systems are not secure and are easily knocked out of alignment. Therefore, a secure scope mounting structure is desirable on an SKS rifle.

The SKS rifle includes a receiver cover positioned over the receiver assembly, near the rearward end of the rifle. After removing the mounting pin, the receiver cover can be removed from the rifle by pulling the cover rearwardly. The standard receiver cover provided with SKS rifles has a relatively smooth outer surface without any structure to mount a telescopic sight or similar sighting device. Therefore, a rifle owner wanting to use a scope on an SKS rifle must machine or tap the receiver cover and/or add an aftermarket mount to secure a scope to the rifle. Many SKS rifle owners may not want an aftermarket mount, or may not have proper tools or the mechanical ability to perform such modifications to the rifle. Furthermore, SKS rifle owners may not want to alter the original components of the rifle by machining, drilling, or other permanent physical change.

Additionally, the standard receiver cover provided with the SKS rifle has a tendency to move laterally (i.e., to the left or right) as well as vertically when the rifle is moved or fired. Thus, any sighting device attached to the standard receiver cover has a certain amount of inaccuracy due to the movement of the receiver cover. Therefore, it is desirable to provide a replacement receiver cover which is securely mounted to the rifle and does not move laterally or vertically when the rifle is moved or fired.

A standard, commercially available mounting structure for attaching telescopic sights to rifles is an elongated rail having a dovetail cross-sectional shape and means for removably attaching the rail to the rifle. Such rails are commonly referred to as "Weaver rails," and many commercially available scopes and scope mounting rings are designed for mounting thereto. Therefore, it is desirable to provide a Weaver-type rail mounting system on a rifle or other firearm.

SUMMARY OF THE INVENTION

The present invention provides a replacement receiver cover for a rifle receiver assembly having a receiver cover, which includes a structure for easily mounting sighting devices to the replacement receiver cover without requiring permanent alteration of the rifle. The inventive receiver cover allows the rifle owner to mount virtually any type of sighting device to the rifle, while maintaining the ability to use the standard iron sights provided on the rifle. Furthermore, the inventive receiver cover provides a pair of side rails which reduce lateral as well as vertical movement of the receiver cover, thereby minimizing the inaccuracy of the sighting device due to movement of the cover during rifle handling and firing.

The replacement receiver cover includes a longitudinal outer surface extending between opposite ends of the receiver cover. A pair of longitudinal side rails extend from the receiver cover and are positioned on opposite sides of the cover to reduce movement of the receiver cover on the firearm. A pair of mounting guides are positioned longitudinally on the outer surface of the receiver cover and provide a location for mounting a sighting device. A longitudinal channel is defined by the pair of mounting guides.

In the preferred form, the longitudinal channel has a substantially planar bottom surface and substantially perpendicular upstanding side walls, such that the channel has a rectangular cross section. The longitudinal channel provides unobstructed viewing along the longitudinal axis of the firearm, thereby permitting the firearm operator to use the conventional iron sights attached to the firearm.

Preferably, the mounting guides have a dovetail configuration created by an undercut surface on each mounting guide. This dovetail configuration permits mounting of various commercially available sighting devices.

In the preferred form of the invention, the side rails contain a longitudinal groove adapted to receive a rubber insert. The rubber insert creates a tight fit between the receiver cover and the firearm as well as preventing scratching of the metal surfaces caused by direct metal-to-metal contact.

In an alternate embodiment of the invention, a hollow mounting tube is secured within the longitudinal channel formed by the mounting guides. The mounting tube has an aperture extending longitudinally through the tube and permits viewing along the longitudinal axis of the firearm. The mounting tube also contains a plurality of apertures for receiving mounting screws used to attach a sighting device to the mounting tube. In one embodiment, the mounting tube extends a considerable distance beyond the end of the receiver cover for deflecting shell casings ejected from the firearm.

BRIEF DESCRIPTION OF THE DRAWINGS

FIG. 4 is a bottom view of the receiver cover of FIG. 1A;

FIG. 5 is a side view of the receiver cover of FIG. 1A, showing the side opposite that shown in FIG. 2;

FIG. 6 is an end view of the receiver cover of FIG. 1A with rubber inserts installed in each side rail groove;

FIG. 7 is an end view of the receiver cover of FIG. 1A, showing the end opposite that shown in FIG. 6, but with the rubber inserts removed;

FIG. 8 is a side view of the receiver cover with an attached telescopic sight;

FIG. 9 is an end view of the receiver cover and telescopic sight of FIG. 8;

FIG. 10 is a perspective view of the inventive receiver cover with an attached mounting tube;

FIG. 11 is an end view of the receiver cover and mounting tube of FIG. 10;

FIG. 12 is a perspective view of the inventive receiver cover with an attached mounting tube and a Weaver rail mounting system; and FIG. 13 is a perspective view of the assembly shown in FIG. 12 with an attached telescopic sight.

DETAILED DESCRIPTION OF THE PREFERRED EMBODIMENT

Figure 1:
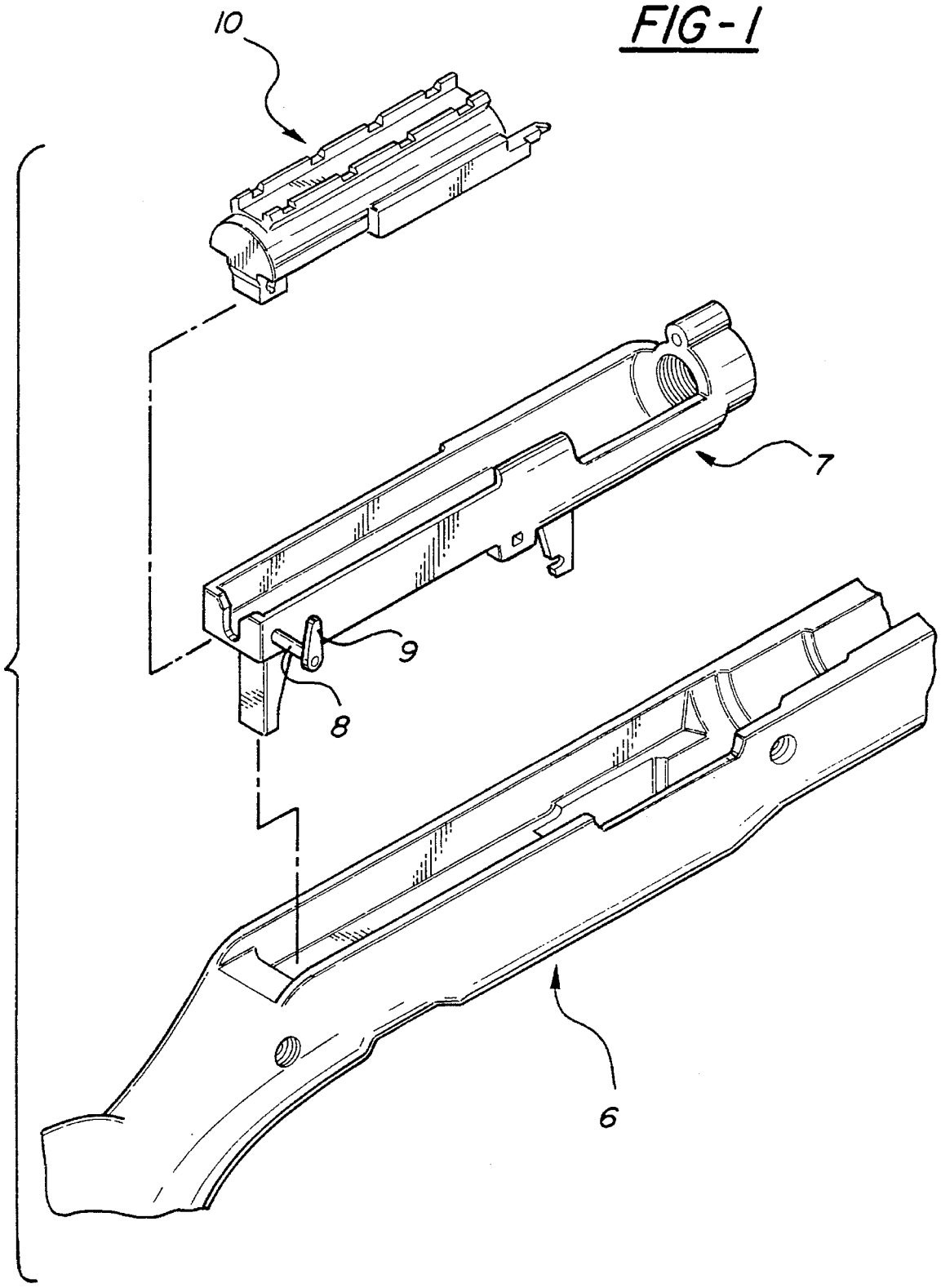
FIG. 1 is an exploded perspective view showing the stock, receiver, and receiver cover of an SKS rifle.

FIG. 1 illustrates an SKS rifle stock 6, receiver assembly 7, and replacement receiver cover 10. Receiver assembly 7 is secured to rifle stock 6 and includes a mounting pin 8 with a lever 9 attached to the end of the mounting pin. Mounting pin 8 secures receiver cover 10 to receiver assembly 7.

Figure 1A:
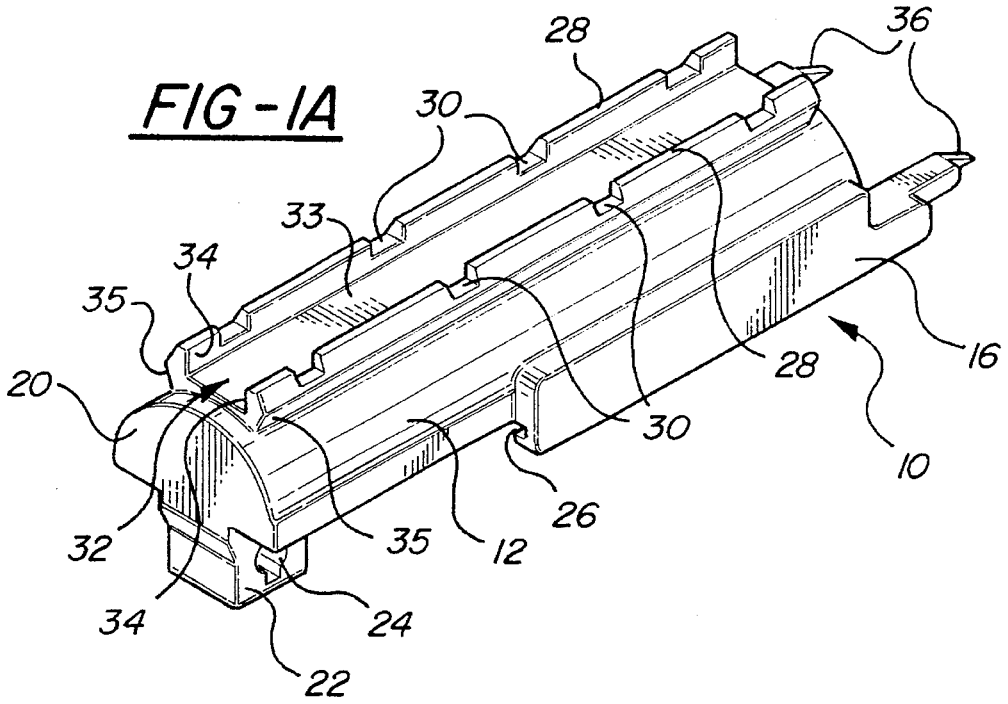
FIG. 1A is a perspective view showing the inventive receiver cover having an integral scope mounting structure.
Figure 2:
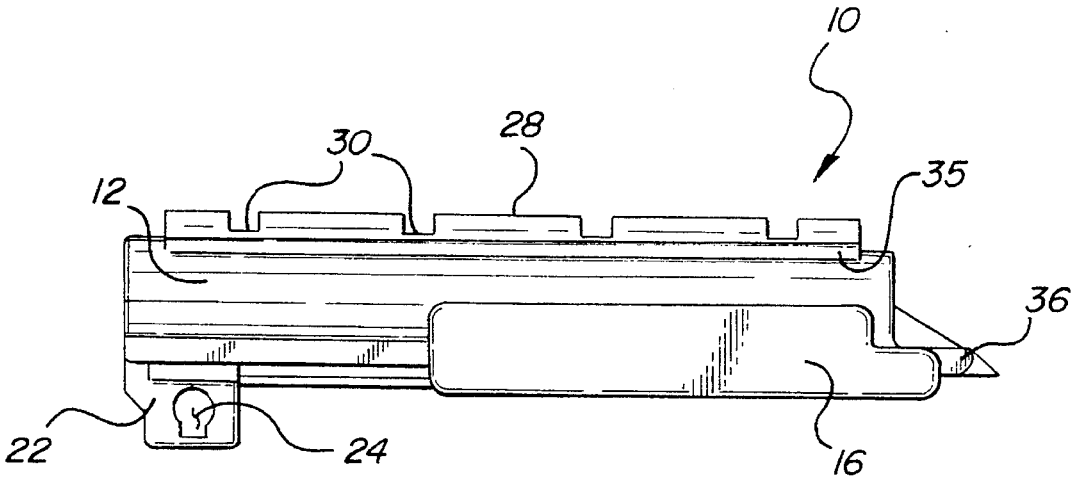
FIG. 2 is a side view of the receiver cover of FIG. 1A.

Referring to FIG. 1A, replacement receiver cover 10 for an SKS rifle is illustrated. Receiver cover 10 has a semi-cylindrical unitary body 12 which defines a semi-cylindrical cavity 14 (shown in FIGS. 4 and 7). Cavity 14 is provided to permit the receiver cover 10 to surround, but not interfere with, the mechanism contained in receiver assembly 7. In the preferred embodiment, receiver cover 10 is manufactured from a material such as 4140 steel using an investment die cast process. Alternatively, receiver cover 10 may be milled from a piece of steel stock using a billet milling process.

Figure 3:
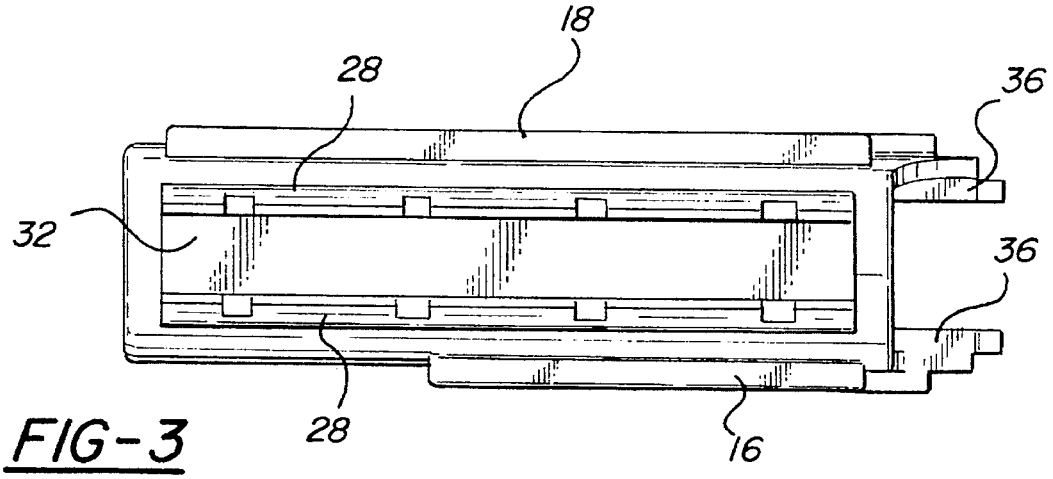
FIG. 3 is a top view of the receiver cover of FIG. 1A.

A first side rail 16 extends along the longitudinal axis of receiver cover 10. As shown in FIG. 3, a second side rail 18 also extends along the longitudinal axis of receiver cover 10. Side rails 16 and 18 are located on opposite sides of receiver cover 10. In the preferred form, side rails 16 and 18 are integrally formed on the outer surface of receiver cover 10. As shown in FIG. 3, side rail 16 is shorter than side rail 18 because mounting pin 8 and attached lever 9 extend along the side of receiver cover 10 on which side rail 16 is located. Mounting pin 8 and lever 9 must be secured tightly against the outer surface of receiver cover 10. Therefore, side rail 16 is shorter to provide clearance for the mounting pin and lever.

Preferably, side rails 16 and 18 are formed on receiver cover 10 when the cover is cast, thus requiring only a single casting operation. Alternatively, side rails 16 and 18 may be welded to receiver cover 10 or milled into the cover by milling the receiver cover from a single piece of stock.

Referring to FIG. 7, side rails 16 and 18 have a longitudinal groove 26 formed on the inner surface of each side rail. Preferably, grooves 26 are cast into side rails 16 and 18. Alternatively, grooves 26 may be machined into side rails 16 and 18 after the receiver cover and side rails are cast.

Referring to FIG. 6, groove 26 is adapted to receive one or more rubber inserts 27. Each rubber insert 27 has a cylindrical shape with a diameter slightly larger than the lateral width of groove 26. When inserted into groove 26, each rubber insert 27 extends inwardly from the inner surface of side rail 16 or 18. Thus, rubber inserts 27 act as buffers between side rails 16, 18 and receiver assembly 7, thereby preventing scratching of the metal surfaces caused by metal-to-metal contact. Additionally, rubber inserts 27 provide a tight fit between receiver cover 10 and receiver assembly 7 to further reduce lateral and vertical movement of the receiver cover. The rifle owner can adjust the tightness of the fit between receiver cover 10 and receiver assembly 7 by replacing rubber inserts 27 with inserts having a different diameter.

In an alternate form of the invention, groove 26 is not required and rubber inserts 27 are bonded to the inner surface of side rails 16 and 18 using an adhesive. In yet another embodiment of the invention, plastic tape (not shown) may be attached to the inner surface of side rails 16 and 18 rather than using any type of rubber insert. The function of any rubber insert or plastic tape is to provide a tight fit between receiver cover 10 and receiver assembly 7 as well as preventing scratching of the metal surfaces. However, use of an insert or plastic tape is not required, and a rifle owner may choose to attach the receiver cover to the receiver assembly without any type of insert attached to the side rails.

Referring again to FIG. 1A, receiver cover 10 contains a closed end 20 and an opposite open end forming an entrance to cavity 14. An integral mounting post 22 extends downwardly from closed end 20 and is adapted to be secured to the rifle receiver assembly 7. Mounting post 22 contains a keyhole-shaped aperture 24 which receives mounting pin 8 of receiver assembly 7.

A pair of guides 28 extend upwardly from the outer surface of receiver cover 10 and along the longitudinal axis of the receiver cover. A substantially rectangular channel 32 is formed between guides 28 and includes a substantially planar bottom surface 33 and substantially perpendicular upstanding side walls 34. Each guide 28 contains an undercut 35 on the outer surface of the guide, thereby creating a dovetail configuration. A plurality of notches 30 are formed in each guide 28 such that each notch in one guide aligns with a corresponding notch in the second guide on the opposite side of channel 32. In the preferred embodiment, guides 28 are integrally formed on receiver cover 10 during the casting process.

Alternatively, guides 28 can be attached to a separate base portion (not shown), thereby forming a channel 32 having a substantially rectangular shape. The base portion with attached guides is then attached to the firearm.

A pair of integral prongs 36 extend axially from the end of receiver cover 10 and act to secure the receiver cover to the firearm, by interacting with the receiver assembly structure. Prongs 36 are located on opposite sides of receiver cover 10.

Referring to FIG. 8, receiver cover 10 is shown with an attached scope 40. Scope 40 contains a pair of scope mounting rings 42 which are secured to guides 28. As shown in FIG. 9, mounting rings 42 have a shape which conforms to that of guides 28, thereby providing a secure mounting arrangement.

Referring to FIG. 10, an alternate embodiment of the invention is illustrated. Receiver cover 10 is identical to the receiver cover described above, with the addition of a hollow mounting tube 44 positioned in channel 32. Mounting tube 44 has a square cross-sectional shape and is adapted to fit closely between guides 28. Mounting tube 44 is preferably welded to receiver cover 10, thereby creating a rigid attachment. Alternatively, mounting tube 44 can be secured to receiver cover 10 using screws or other mounting fasteners known to those skilled in the art.

Mounting tube 44 can have a variety of lengths depending on the requirements of the firearm owner and the type of sighting devices which will be attached to the mounting tube. FIG. 10 illustrates a receiver cover 10 with a long mounting tube 44 attached. Mounting tube 44 extends a considerable distance beyond the end of receiver cover 10, thereby permitting the mounting of a full-sized rifle scope, as illustrated in FIG. 13.

In an alternate embodiment (not shown), mounting tube 44 is shorter and approximately the same length as receiver cover 10. This shorter mounting tube is used to mount "mini scopes" (e.g. six inch scopes) and allows the scope to be mounted to the rifle while quick feeding the rifle magazine using stripper clips. The longer mounting tube 44 shown in FIG. 13 does not permit the use of stripper clips because the mounting tube extends over the magazine opening and prevents quick feeding of the rifle magazine.

As shown in FIG. 11, mounting tube 44 contains an aperture 46 having a substantially square cross section and extending longitudinally through the tube. Aperture 46 provides an unobstructed view along the longitudinal axis of the firearm and permits the firearm operator to use the conventional iron sights if desired.

Referring again to FIG. 10, a plurality of threaded apertures 48 are located along the top surface of mounting tube 44. Apertures 48 provide several different mounting locations for attaching a scope or other sighting device. Mounting tube 44 and apertures 48 permit the mounting of a scope or scope ring 1 base requiring a flat mounting surface.

As shown in FIG. 12, a sighting device mounting rail 52 such as a Weaver rail may be attached to mounting tube 44 by inserting screws 56 through the apertures in mounting rail 52 and into threaded apertures 48. Once mounting rail 52 has been secured to mounting tube 44, a scope 40' can be mounted to the Weaver rail using mounting rings 42'.

In operation, replacement receiver cover 10 replaces the standard receiver cover provided with an SKS rifle. The standard receiver cover is removed by releasing mounting pin 8 and sliding the receiver cover rearwardly. Replacement receiver cover 10 is then installed by sliding the cover forwardly onto receiver assembly 7 and securing mounting pin 8. Receiver cover 10 may be removed from the rifle in the same manner as described above, for cleaning or inspection of the rifle.

When mounted to the rifle, side rails 16 and 18 on replacement receiver cover 10 reduce lateral and vertical movement of the receiver cover with respect to receiver assembly 7. Any lateral or vertical movement of receiver cover 10 would alter the aiming orientation of the sighting device attached to the receiver cover. By reducing movement of receiver cover 10, the accuracy and consistency of the sighting device attached to the receiver cover is improved. Thus, firing and handling of the firearm does not alter the position of receiver cover 10 or the aiming orientation of the sighting device.

Rubber inserts 27 provide a tight fit between receiver cover 10 and the receiver assembly. The tightness of the fit between receiver cover 10 and the receiver assembly can be varied by using a rubber insert 27 having a different diameter. Rubber inserts 27 having a large diameter will provide a tighter fit than inserts having a smaller diameter.

Channel 32 formed by guides 28, provides an unobstructed view along the longitudinal axis of the firearm to which receiver cover 10 is attached. Thus, guides 28 on receiver cover 10 do not interfere with the gun operator's ability to use the conventional iron sights on the SKS rifle.

Notches 30 in guides 28 provide a location for scope mounting screws or scope ring screws to pass through the guides. Furthermore, these notches 30 prevent the attached scope from moving longitudinally along guides 28 when the rifle is fired.

The configuration of guides 28 with undercuts 35 is similar to the Weaver rail mounting system commonly used to secure sighting devices to firearms. Therefore, an SKS rifle owner can select from a large variety of commercially available sighting devices which can be attached to guides 28.

Referring to FIG. 13, a long mounting tube 44 permits attachment of a full-sized rifle scope 40' on the tube. Since mounting tube 44 extends a considerable distance beyond receiver cover 10, the mounting tube acts as a deflector for shells ejected upwardly from the firearm. Without the extended portion of mounting tube 44, the shells would be ejected against scope 40', creating dents and scratches on the scope. Furthermore, the longer mounting tube 44 permits scope 40' to be mounted further forward on the tube than would be possible with a shorter mounting tube. As shown in FIG. 13, the forward scope ring 42' is located ahead of receiver cover 10, in a position which would not be available if a shorter mounting tube were used.

If a shorter scope is to be used with the rifle, a shorter mounting tube may also be used since the shorter scope will not extend over the bolt opening where the shell cases are ejected. If the scope is of sufficiently small size, it can be mounted directly to guides 28, without the use of any mounting tube 44.

SKS rifle owners desiring to use several different scopes on the same rifle at different times may obtain several receiver covers 10 and attach a different scope to each receiver cover. Receiver cover 10 can be easily and quickly removed from the rifle and replaced with a different receiver cover onto which is mounted a different scope. Each receiver cover 10 is securely attached to the rifle in the same position during each installation and, therefore, does not require re-zeroing of the scope each time the receiver cover is installed. Thus, a rifle owner may quickly switch between several different scopes while maintaining an accurate, consistent aiming orientation.

Although the present invention has been described as having integral side rails 16, 18 and integral guides 28, it will be understood by those skilled in the art that the side rails and guides may be attached to an existing receiver cover by welding or other fastening mechanism.

I claim:

1. A sighting device mount for securing a sighting device to a receiver assembly of a rifle comprising:

a replacement receiver cover adapted to be secured to said receiver assembly to enclose at least a portion of the interior of said receiver assembly;

a sighting device mounting structure integrally formed on said replacement receiver cover; and a pair of longitudinal side rails extending from opposite sides of said replacement receiver cover for contacting said receiver assembly and thereby reducing movement of said replacement receiver cover relative to said receiver assembly.

2. The apparatus of claim 1 wherein said scope mounting structure comprises a pair of mounting guides disposed longitudinally on the outer surface of said replacement receiver cover, said mounting guides defining a longitudinal channel therebetween.

3. The apparatus of claim 2 wherein said longitudinal channel contains a substantially planar bottom surface and substantially perpendicular upstanding side walls.

4. The apparatus of claim 2 wherein said mounting guides have a dovetail configuration formed by an undercut surface on each guide.

5. The apparatus of claim 2 further including a hollow mounting tube secured within said longitudinal channel, said mounting tube adapted to receive said sighting device in securing engagement.

6. The apparatus of claim 1 wherein said side rails include a longitudinal groove formed therein and adapted to receive an insert for providing a tight fit between said replacement receiver cover and said receiver assembly.

7. The apparatus of claim 1 wherein each side rail includes an inner surface onto which an insert is attached for providing a tight fit between said replacement receiver cover and said receiver assembly.

8. A replacement receiver cover for attachment to a receiver assembly of a firearm to enclose at least a portion of the interior of the receiver assembly said replacement receiver cover having an integral mounting structure for securing a sighting device, said receiver assembly having a mounting pin for securing the replacement receiver cover to the receiver assembly, said replacement receiver cover comprising:

a semi-cylindrical unitary body having a first closed end, a second open end, and a longitudinal outer surface therebetween, and semi-cylindrical body defining a semi-cylindrical cavity therein;

a pair of integral, longitudinal side rails extending from opposite sides of said body for contacting said receiver assembly and hereby reducing movement of said replacement receiver cover relative to said receiver assembly;

a pair of integral prongs extending from said second end of said body for securing said replacement receiver cover to said receiver assembly;

an integral mounting post extending from said first end of said body, said mounting post having an aperture adapted to receive said mounting pin;

a pair of integral mounting guides disposed longitudinally on the outer surface of said body and defining a longitudinal channel therebetween; and a hollow mounting tube secured within said longitudinal channel, said mounting tube adapted to receive said sighting device in securing engagement.

9. The apparatus of claim 8 wherein said mounting tube has a substantially square cross-sectional shape and a substantially square aperture extending longitudinally therethrough to permit viewing along the longitudinal axis of the firearm.

10. The apparatus of claim 8 wherein said mounting tube includes a plurality of apertures for receiving a plurality of mounting screws to secure said sighting device to said tube.

11. The apparatus of claim 8 wherein said mounting tube is secured within said longitudinal channel by welding.

12. The apparatus of claim 8 further including an elongated sighting device mounting rail disposed on said mounting tube.

13. The apparatus of claim 8 wherein said mounting tube has a length which is slightly greater than the length of said body such that said tube extends slightly beyond said second end of said body.

14. The apparatus of claim 8 wherein said mounting tube extends substantially beyond said second end of said body and is positioned between said sighting device and said rifle to prevent ejected shells from contacting said sighting device.

* * * * *